US005156079A

United States Patent [19]

El-Shiekh et al.

[11] Patent Number: 5,156,079

[45] Date of Patent: Oct. 20, 1992

[54] YARN CARRIER APPARATUS FOR BRAIDING MACHINES AND THE LIKE

[75] Inventors: Aly El-Shiekh; Wei Li; Mohamed Hammad, all of Raleigh, N.C.

[73] Assignee: North Carolina State University, Raleigh, N.C.

[21] Appl. No.: 533,482

[22] Filed: Jun. 5, 1990

[51] Int. Cl.[5] ..... D04C 3/18

[52] U.S. Cl. ..... 87/57; 87/61

[58] Field of Search ..... 87/54, 55, 56, 57, 61, 87/22; 242/128, 107, 107.5

[56] References Cited

U.S. PATENT DOCUMENTS

| | | | |
|---|---|---|---|
| 1,135,702 | 4/1915 | Larson | 87/57 |
| 1,614,099 | 1/1927 | Blaisdell . | |
| 2,049,385 | 7/1936 | Krissiep | 96/13 |
| 2,167,930 | 8/1939 | Krissiep | 96/13 |
| 2,776,804 | 1/1957 | Prout et al. | 242/129.3 |
| 2,911,875 | 11/1959 | Ostermann et al. | 87/21 |
| 3,038,367 | 6/1962 | Karg et al. | 87/22 |
| 3,426,804 | 2/1969 | Bluck | 139/11 |
| 4,529,147 | 7/1985 | Bull et al. | 242/156.2 |
| 4,700,607 | 10/1987 | Heine | 87/57 |
| 4,736,668 | 4/1988 | Moyer | 87/57 |
| 4,903,574 | 2/1990 | Brown et al. | 87/57 |

*Primary Examiner*—Joseph J. Hail, III
*Attorney, Agent, or Firm*—Richard E. Jenkins

[57] ABSTRACT

A yarn carrier apparatus particularly suited for use in braiding machinery or the like due to its capability of continuous yarn feeding and retraction of long lengths of yarn. The yarn carrier apparatus comprises a yarn supply spool which is rotatably mounted within the housing, a spring motor also mounted within the housing and operatively connected to the yarn supply spool through a mechanical transmission assembly which is adapted to multiply rotational movement between the first element of the gear assembly operatively connected to the spring motor and the final element of the gear assembly operatively connected to the yarn supply spool. The spring motor is adapted to tension the yarn during both feeding and retraction thereof, and it is further adapted to periodically rotatably slip within the housing and partially unwind so as to allow for continuous withdrawal of a long length of yarn without the spring motor becoming fully wound and preventing further yarn retraction.

9 Claims, 6 Drawing Sheets

YARN CARRIER APPARATUS FOR BRAIDING MACHINES AND THE LIKE

GOVERNMENT INTEREST

This invention was made with Government support under Grant NAGW-1331 awarded by the National Aeronautics and Space Administration (NASA). The Government has certain rights therein.

TECHNICAL FIELD

The present invention relates to a yarn carrier apparatus for feeding yarn to a braiding machine or the like and, more particularly, to a yarn carrier apparatus adapted to provide a continuous supply of yarn under tension and to retract longer lengths of yarn than heretofore possible.

BACKGROUND ART

As is well known in the textile art, braiding machines utilize fiber carriers which are placed in motion in order to intertwine yarns to form a braided material. Multiply braiding machines typically use a matrix-like configuration of yarn carriers which move in alternate row and column position shifts. By reversing the movement of row and column motions of yarn carriers during operation of a braiding machine, the yarns are intertwined together to form a braided product, typically a complex shape not possible to manufacture by other types of textile processes.

As is also known in the textile art, three-dimensional braiding processes have become recognized for their advantage in fabricating integrated and near net-shaped preforms for advanced composite materials which are used, for example, in rocket nozzles and the like in the U.S. space program. Three-dimensional braiding has the capability of fabricating three-dimensional integrated structures, and also provides great ease in forming complex structural shapes. With three-dimensional braiding desired preforms can be directly fabricated into the nearly net shapes of the final products of the composite material by manipulating the relative positions of the individual yarns or fiber tows in the braiding machine bed. The technology has recently attracted a great amount of attention from various industries, including the aerospace industry, and made three-dimensional braided composite products a very active and prominent branch of advanced composite materials.

In view of the above, a significant research effort is underway to automate three-dimensional braiding processes in order to produce uniform, repeatable and cost-effective products therefrom. For example, in the School of Textiles at North Carolina State University a three-dimensional braiding laboratory is working toward developing automated three-dimensional braiding machines, including both four-step (Cartesian or Magna Weave) and two-step braiding apparatus.

With particular reference to automated three-dimensional braiding machines, researchers at North Carolina State University have discovered that large moving distances of the yarn carriers across the braiding machine bed are required, and thus a large rewinding or retraction capability for the yarn carriers is a necessity for the further development of this technology. It has further been discovered that yarn carriers with continuous yarn supply and retraction capability will have to be utilized in the three-dimensional braiding machines. Unfortunately, the yarn carriers which are presently available are capable of continuously supplying yarn but are unsatisfactory for three-dimensional braiding machines due to the fact that the rewinding lengths or retraction capability are very limited. In this regard see, for example, the yarn carrier disclosed in Heine U.S. Pat. No. 4,700,607. Also, applicants are aware of a limited retraction braiding yarn carrier device manufactured by A. B. Carter Company of Gastonia, N.C., which comprises a yarn spool mounted directly on a spring motor which is adapted to tighten and then partially unwind by rotatably slipping within the carrier housing during continuous yarn supply. Although the device can provide a long continuous supply of yarn, the retraction capability is limited by the direct mounting of the yarn spool on the spring motor thereof.

Accordingly, a need has arisen for such a yarn carrier apparatus which, while compact, will provide both continuous yarn supply and the requisite large rewinding lengths necessary for automated braiding machines as well as other suitable uses for such a yarn carrier apparatus. The yarn carrier apparatus of the present invention meets this need in view of its surprising yarn feeding and high retraction capabilities.

DISCLOSURE OF THE INVENTION

The yarn carrier apparatus of the present invention generally comprises a housing having a yarn supply spool rotatably mounted therein for feeding yarn to a braiding machine and taking-up yarn from a braiding machine during operation thereof. A spring motor is mounted within the housing and operatively connected to the yarn supply spool for providing tension on the yarn being fed to the braiding machine and taking-up yarn onto the spool when the yarn being fed becomes slack. A drive means is operatively connected between the spring motor and the yarn supply spool for transmitting biasing force from the spring motor to the yarn supply spool. The drive means comprises a first rotational drive element operatively connected to the spring motor and a second rotational drive element operatively connected to the yarn supply spool, and it is adapted to multiply rotational movement between the first rotational drive element and the second rotational drive element to provide enhanced yarn retraction capability.

The yarn carrier apparatus may be provided with a guide plug, wheels or the like at the bottom end of the housing for allowing the yarn carrier apparatus of the invention to be moved in the braiding machine bed during the operation of the braiding machine.

It is therefore the object of the present invention to provide a yarn carrier apparatus for use with a braiding machine or the like which provides for continuous yarn feed under tension and the retraction of large lengths of yarn periodically during the braiding process.

It is also an object of the present invention to provide a yarn carrier apparatus which is small and compact and yet can continuously feed and periodically retract large lengths of yarn as required during operation of a three-dimensional braiding machine.

It is another object of the present invention to provide a yarn carrier apparatus which utilizes a spring motor capable of repetitive partial unwinding during yarn feeding so as to continuously feed a substantial length of yarn under tension to a braiding machine.

It is still another object of the present invention to provide a yarn carrier apparatus which incorporates a gear mechanism between the spring motor and the yarn supply spool so as to facilitate retraction of a large length of yarn during three-dimensional braiding.

It is yet another object of the present invention to provide a yarn carrier apparatus of compact size and simple construction which is capable of feeding at least 90 feet of yarn under tension to a braiding machine or the like and retracting at least 25 feet of yarn as periodically required during the braiding process.

Some of the objects of the invention having been stated, other objects will become evident as the description proceeds, when taken in connection with the accompanying drawings described below.

BEST MODE FOR CARRYING OUT THE INVENTION

Figure 1:
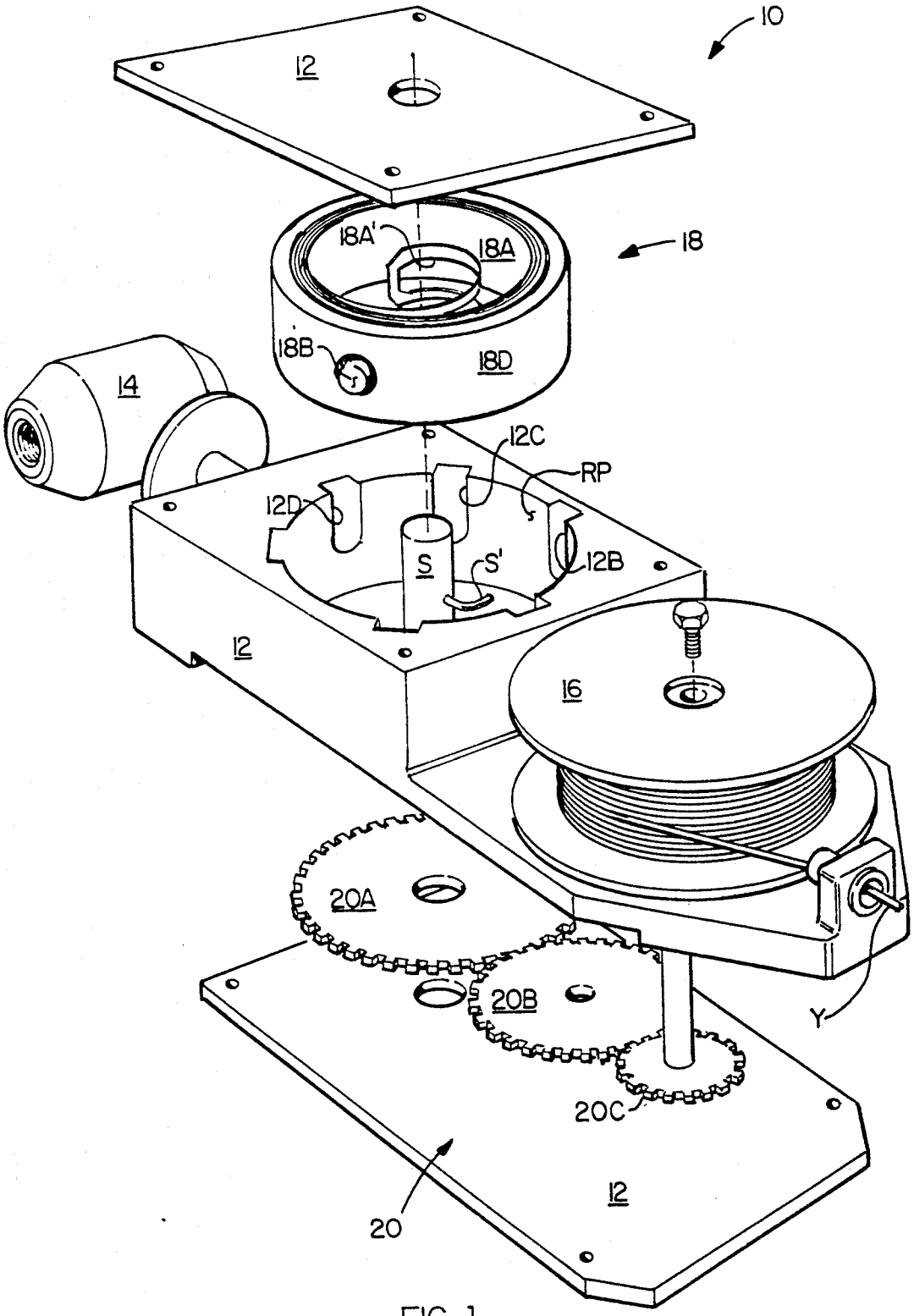
FIG. 1 is a perspective view of a yarn carrier apparatus constructed in accordance with the present invention with parts exploded for clarity of understanding.
Figure 2:
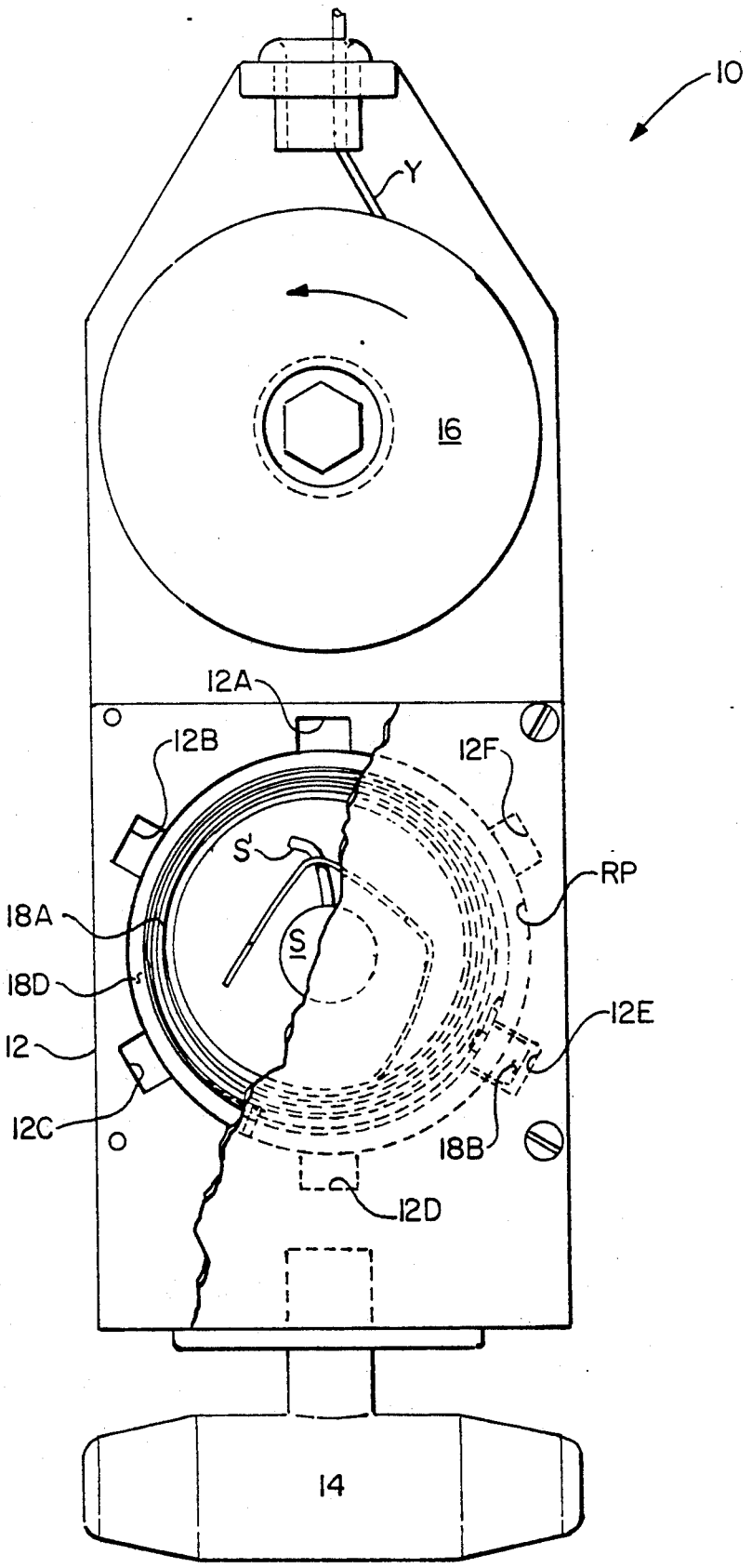
FIG. 2 is a spool-side elevational view, with parts broken away, of the yarn carrier apparatus shown in FIG. 1.
Figure 3:
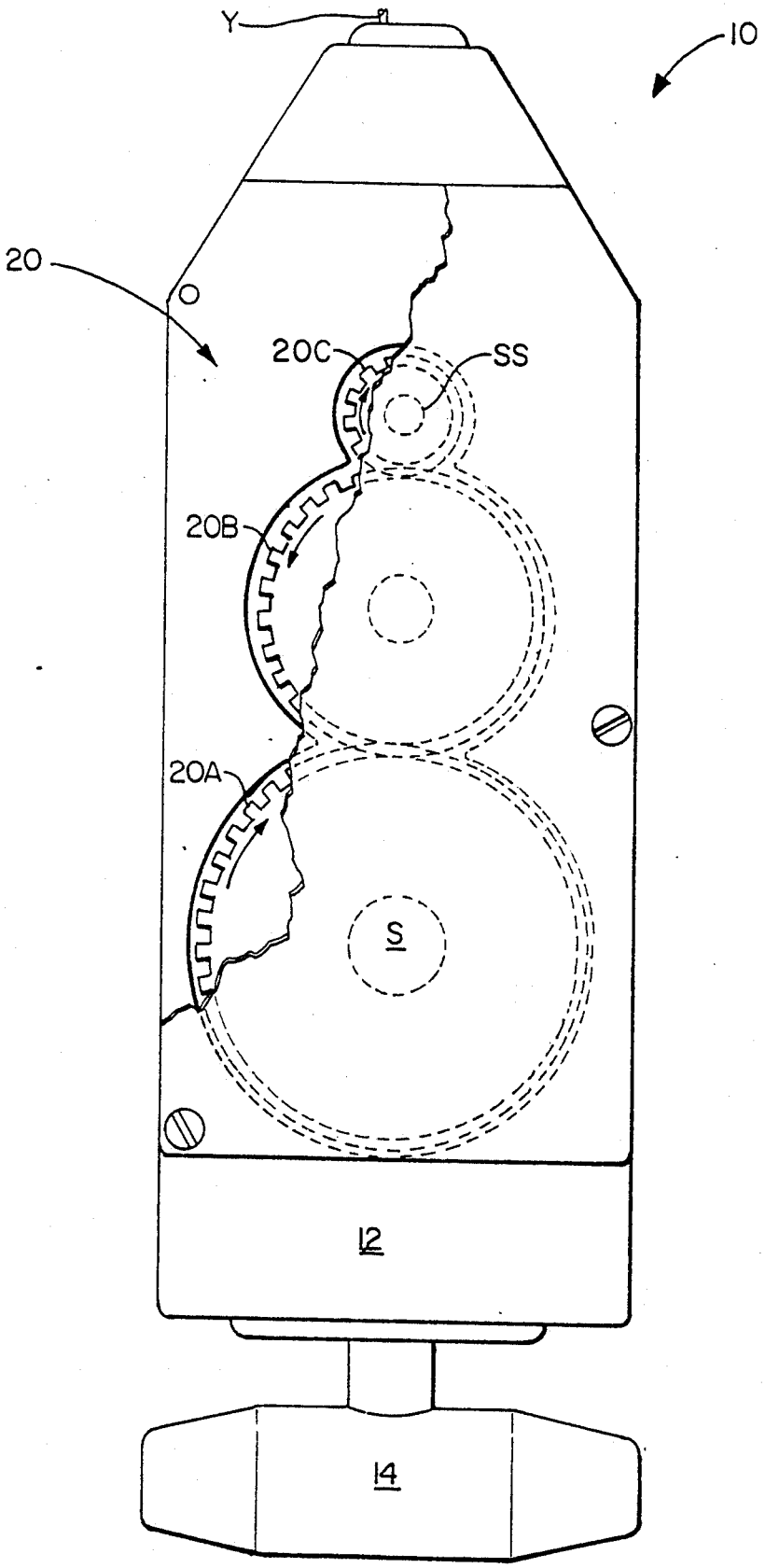
FIG. 3 is a gear-side elevational view, with parts broken away, of the yarn carrier apparatus shown in FIG. 1.
Figure 4:
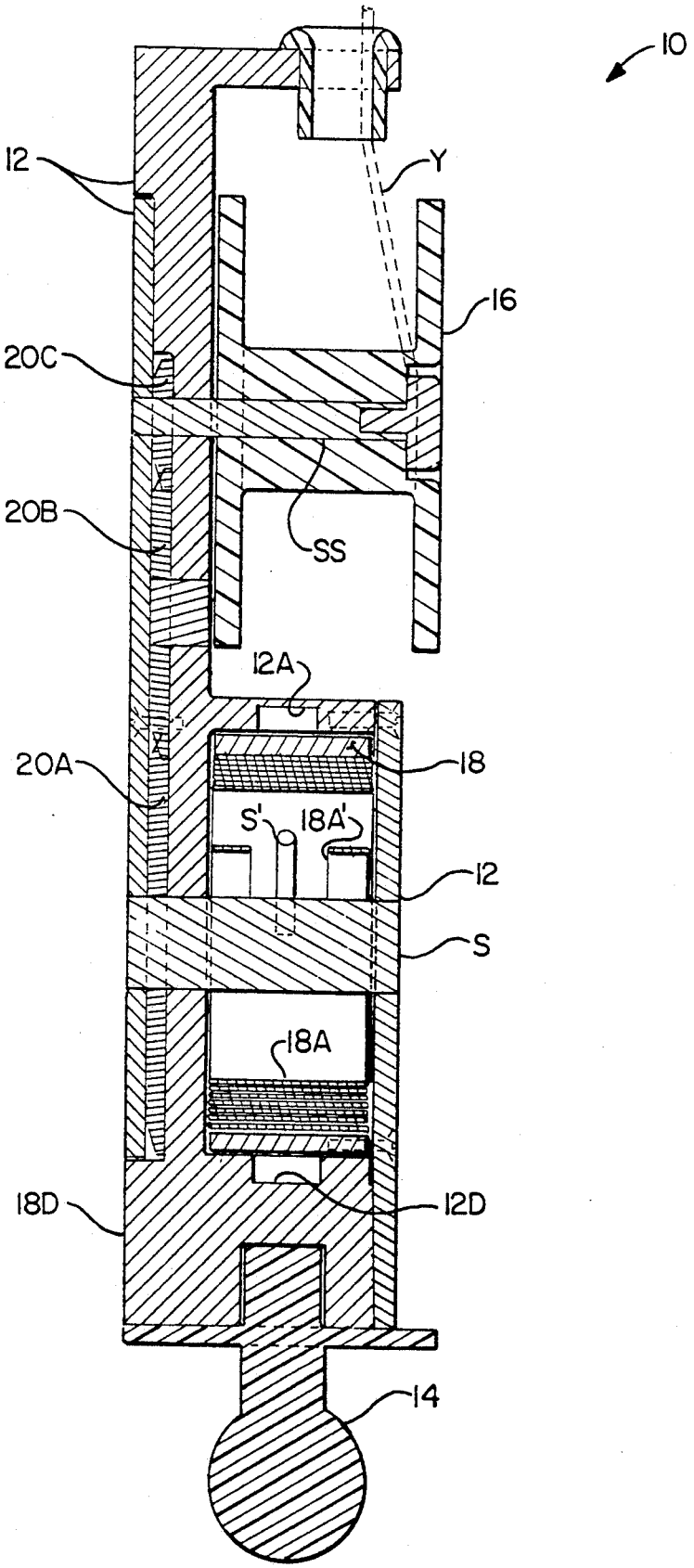
FIG. 4 is a vertical sectional view of the yarn carrier apparatus shown in FIG. 1.

Referring now more specifically to the drawings, a preferred embodiment of the yarn carrier apparatus according to the present invention is shown in FIGS. 1–4 and generally designated 10. Yarn carrier 10 comprises a housing 12 with a guide plug 14 or the like secured to the bottom thereof to enable yarn carrier 10 to be motivated in the bed of a three-dimensional braiding machine.

A removable yarn supply spool 16 with a continuous strand or yarn Y wound thereon for feeding to an automated braiding machine is rotatably mounted within housing 12 on shaft SS. Applicants contemplate that the term "yarn" includes many types of strands including but not limited to spun yarn, continuous filament, tow, cordage, wire, and the like. Although different lengths of yarn Y can be wound onto yarn supply spool 16, it should be appreciated that yarn supply spool 16 can carry 30 yards or more of yarn Y if required by the braiding machine. A spring motor 18 is also mounted within housing 12 and serves to drive rotatable shaft S. Spring motor 18 is most suitably removably positioned within a cylindrical recessed portion RP defined by housing 12 and may be easily replaced by another motor. As will be explained in more detail hereinafter, spring motor 18 is adapted to wind tight and then partially unwind by rotatably slipping within housing 12 so as to allow for feeding of a long length of yarn Y under tension from yarn carrier 10 without spring motor 18 becoming fully wound and stopping the unwinding of yarn Y from yarn supply spool 16. For example, yarn carrier 10 can continuously feed under tension the entire length of at least 30 yards of yarn Y which is wound on yarn supply spool 16.

A gear assembly 20 is provided between spring motor 18 and yarn supply spool 16 so as to increase the winding ratio between the motor and the spool to provide for a large yarn take-up or retraction capability of yarn carrier 10. For example, with gear assembly 20 comprising a 60-tooth gear 20A operatively secured to spring motor 18 by shaft S and driving an intermediate 42-tooth gear 20B which in turn drives a 15-tooth gear 20C operatively connected to yarn supply spool 16 by shaft SS, it is possible to achieve a yarn retraction capability of as little as 10 inches and up to as much as 25 feet or more due to the multiplier or winding ratio provided by gear assembly 20. Although other ratios are possible, applicants presently contemplate that the multiplier or winding ratio provided by gear assembly 20 can most suitably range between 4 and 64 depending on the specific gears incorporated into gear assembly 20. Thus, the spring motor and gear assembly provide for the very surprising and unexpected long length retraction capability of yarn carrier 10 which is lacking in prior art yarn carrier devices. Also, although gear assembly 20 is shown comprising gears 20A, 20B, and 20C, applicants' invention contemplates the use of any suitable drive assembly such as a pulley and belt drive or a sprocket and chain drive.

As explained hereinbefore, yarn carrier 10 represents a significant breakthrough in the development of automated three-dimensional braiding machines since it provides for both the continuous feeding of a long length of yarn under tension to the braiding machine as well as the periodic retraction of long lengths of yarn under tension during the braiding process. The lack of a yarn carrier such as carrier 10 has been one hindrance to date in the development of commercial automated braiding machinery.

Figure 5A:
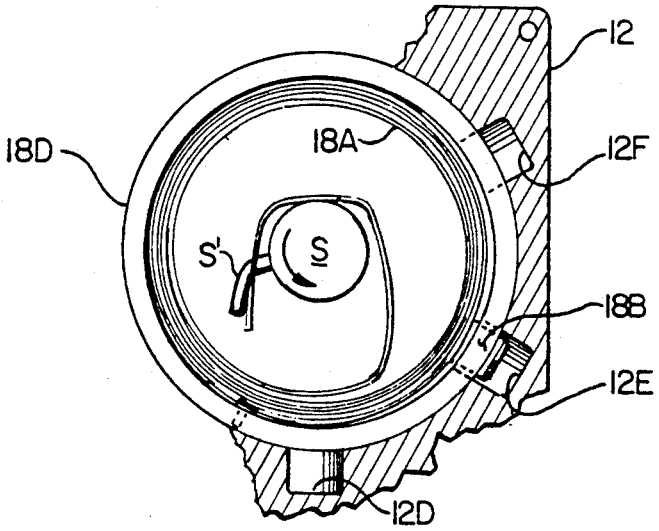
FIGS. 5A–5C are fragmentary views, respectively, of the spring motor at rest, the spring motor tightened as yarn is fed from the yarn supply spool, and the spring motor partly relaxed subsequent to rotatably shifting during the continuous feeding of yarn from the yarn spool.
Figure 5B:
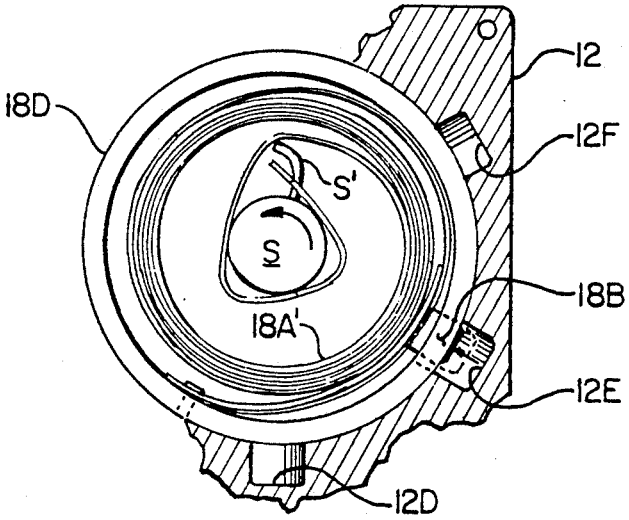
Figure 5C:
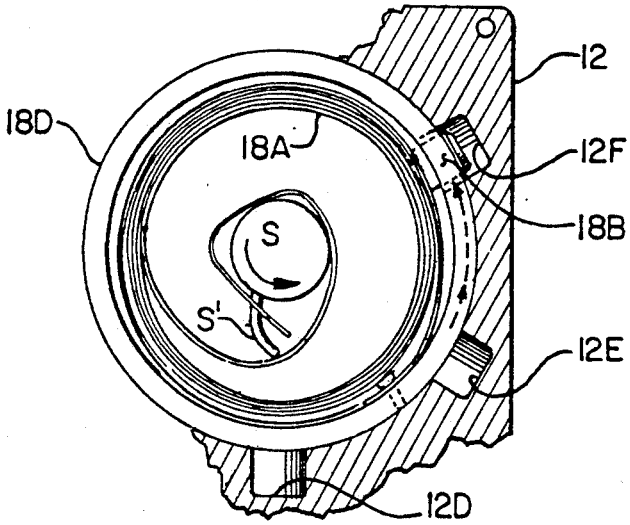
Figure 6:
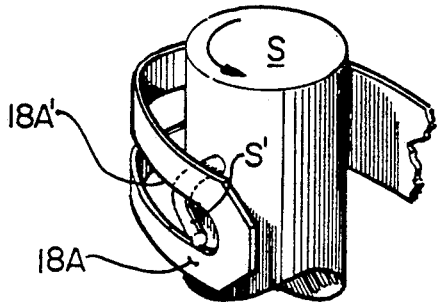
FIG. 6 depicts the rotatable shaft and the end of the coil spring of the spring motor removably secured thereto.
Figure 7:
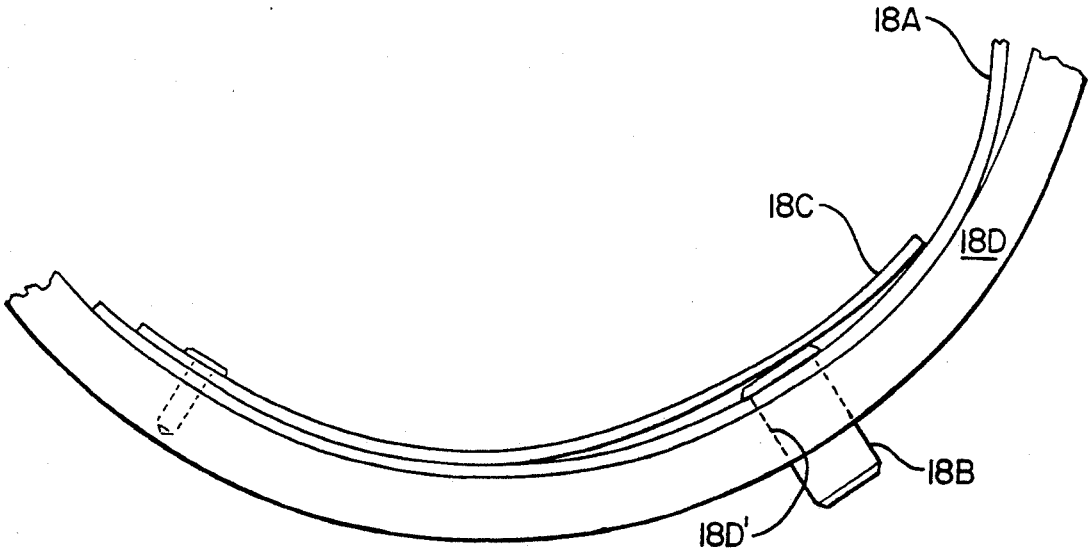
FIG. 7 is a fragmentary view of the arc spring end of the coil spring.

With reference now to FIGS. 5–7 of the drawings, applicants will first describe in detail the functioning of spring motor 18 which provides for continuous feeding of yarn Y under tension, and thereafter describe in detail the functioning of gear assembly 20 which with spring motor 18 provides yarn carrier 10 with the ability to periodically retract under tension long lengths of yarn Y. Spring motor 18 is removably mounted within housing 12 so that, as a matter of choice, different tension spring motors may be utilized with yarn carrier 10 in order to change the tension level on yarn Y. Spring motor 18 essentially comprises four components: coil spring 18A, pin 18B, arc spring end 18C, and ring housing 18D. The arc spring end 18C of the coil spring is secured to ring housing 18D which has an aperture 18D' therein through which pin 18B extends (see FIG. 7). The other end of coil spring 18A is removably secured to rotatable shaft S which is affixed to gear 20A of gear assembly 20. As best seen in FIG. 6, the other end of coil spring 18A is removably secured to shaft S by means of slot 18A' therein which is engaged by a finger S' ending outwardly from shaft S. Although other design configurations are possible, the arrangement of slot 18A' in coil spring 18A and finger S' serves to prevent spring end breakage when, for example, spring motor 18 is being quickly removed from housing 12 in order to place a new spring motor therein.

Referring again to FIGS. 5A-5C, it can be seen that housing 12 defines six spaced-apart recesses therein, 12A-12F, which are located around the periphery of spring motor 18 so as to be in sequential registration with aperture 18D' of ring housing 18D and to sequentially receive pin 18B therein when spring motor 18 rotatably shifts within housing 12 as yarn Y is being fed from yarn carrier 10. When coil spring 18A is fully wound due to a portion of yarn Y being removed from yarn supply spool 16 and the rotation of shaft SS which in turn actuates gear assembly 20 so as to rotate shaft S until coil spring 18A is tight, arc spring end 18C is caused to pull away from ring housing 18D and remove pin 18B from recess 12A. Once pin 18B is removed from recess 12A of housing 12, ring housing 18B will rotate so as to partially unwind coil spring 18A and arc spring end 18C will force pin 18B into the next housing recess 12B. Pin 18B will be forced into housing recess 12B and thus stop the rotation of ring housing 18D until coil spring 18A again tightens and pin 18B is thereby removed from its nesting location in recess 12B and ring housing 18D again rotates until pin 18B nestles in housing recess 12C. This sequence continues for recesses 12D, 12E, 12F, and if yarn Y continues to be withdrawn, pin 18B will begin another rotation within housing 12 at recess 12A.

The slippage as described herein allows for spring motor 18 to "slip" or rotate relative to housing 12 and thereby continually partially unwind and allow a long length of yarn Y to be fed under tension from yarn supply spool 16. As noted above, applicants contemplate that at least up to 30 yards of yarn Y may be fed from yarn carrier 10 as required. Also, although described above in terms of sequential movement of pin 18B from one of recesses 12A-12F to the next, the invention also contemplates that pin 18B could move past several of recesses 12A-12F during the rotatable movement thereof to partially unwind spring motor 18 if the spring tension is relatively great.

Although a specific construction of spring motor 18 has been described above, applicants contemplate that other designs of spring motor 18 are within the scope of the invention including the use of an external spring latching mechanism, single and double ball detentes or any other suitable stopping mechanism that allows the spring motor to rotate or "slip" upon demand as the yarn feeding is called for.

With reference again to FIGS. 1-4 of the drawings, applicants will now describe in detail the retraction motion of yarn carrier 10. As in the feeding of yarn Y to a braiding machine, the periodic retraction of yarn Y therefrom onto yarn supply spool 16 during the braiding process is accomplished under tension provided by spring motor 18. When yarn carrier 10 senses slack forming in yarn Y during the braiding process, coil spring 18A of spring motor 18 (which is at least partially wound due to the take-off of yarn Y from yarn supply spool 16) will exert a rotational force through gear assembly 20 to shaft SS upon which yarn supply spool 16 is mounted. The rotational force applied by spring motor 18 to shaft S results in rotational movement thereof which is multiplied through gear assembly 20 so as to multiply the rotational movement of gear 20A through gears 20B and 20C and thereby provide multiple take-up rotations to yarn supply spool 16 for every rotation of shaft S by gear motor 18. Although the exact retraction length is a matter of design choice, applicants contemplate that gear assembly 20 will provide for periodic retraction of as little as 10 inches and as much as 25 feet or more of yarn Y during the braiding process.

Thus, applicants have discovered a compact and lightweight yarn carrier which is capable of continuous yarn feeding and the periodic retraction of greater lengths of yarn than has heretofore been possible. Although the unique features of the yarn carrier lend it well to use in automated three-dimensional braiding machines, it is also contemplated by the inventors as within the scope of the invention that the yarn carrier may be used in other braiding machines as well as in other suitable fabric formation applications such as weaving, knitting and the like wherein the continuous yarn feeding and large take-up capability is desirable. The yarn carrier of the present invention and its components may be made of any suitable materials, such as metal, plastic, or the like.

It will be understood that various details of the invention may be changed without departing from the scope of the invention. Furthermore, the foregoing description is for the purpose of illustration only, and not for the purpose of limitation—the invention being defined by the claims.

What is claimed is:

1. A yarn carrier apparatus having enhanced yarn retraction capability for use with a fabric formation machine and the like, said yarn carrier apparatus comprising:

a housing;

a yarn supply spool rotatably mounted within said housing for feeding yarn therefrom to said fabric formation machine and taking up yarn therefrom during machine operation;

spring motor means mounted within said housing and operatively connected to but having a rotational axis spaced-apart from the rotational axis of said yarn supply spool for providing tension on the yarn being fed to said fabric formation machine and taking up yarn on said spool while maintaining tension on said yarn; and drive means operatively connected between said spring motor means and said yarn supply spool for transmitting biasing force from said spring motor means to said yarn supply spool, said drive means comprising a first rotational drive element operatively connected to said spring motor means, a second rotational drive element operatively positioned between said first and second rotational drive elements so as to multiply rotational movement between said first rotational drive element and said second rotational drive element;

wherein said spring motor means comprises a ring element having a coil spring positioned therein, said coil spring defining engagement means at one end thereof for operatively engaging said first rotational drive element and being secured at the other end thereof to said ring element, said coil spring further comprising a radially movable elongate element secured proximate to the secured end of said spring and extending through an aperture in said ring so as to engage said housing, said elongate element being adapted to be withdrawn radially inwardly when said coil spring is wound tight and to thereby allow said spring motor means to rotate relative to said housing so as to at least partially unwind said spring, said rotating distance being determined by a plurality of spaced-apart recesses defined within said housing around the periphery of said spring motor means.

2. A yarn carrier apparatus according to claim 1 wherein said housing is an elongated housing having said yarn supply spool mounted within one end thereof and said spring motor means mounted within the opposing end thereof.

3. A yarn carrier apparatus according to claim 1 wherein said yarn supply spool is adapted to carry at least 30 yards of yarn thereon.

4. A yarn carrier apparatus according to claim 1 wherein said spring motor means is adapted to be repetitively wound tight and then partially unwound prior to being wound tight again as yarn is being continuously fed under tension by said yarn carrier apparatus to a fabric formation machine.

5. A yarn carrier apparatus according to claim 4 wherein said yarn carrier apparatus can continuously provide at least 30 yards of yarn under tension to a fabric formation machine.

6. A yarn carrier apparatus according to claim 1 wherein said drive means comprises a gear drive.

7. A yarn carrier apparatus according to claim 6 wherein said gear drive provides a drive ratio between said first rotational drive element and said second rotational drive element of between 1:7 and 1:64.

8. A yarn carrier apparatus according to claim 1 wherein said gear drive will provide for continuous retraction of at least 25 feet of yarn under tension onto said yarn supply spool.

9. A yarn carrier apparatus having enhanced yarn retraction capability for use with a fabric formation machine and the like, said yarn carrier apparatus comprising:

a housing;

a yarn supply spool rotatably mounted within said housing for feeding yarn therefrom to said fabric formation machine and taking up yarn therefrom during machine operation, said yarn supply spool being adapted to carry at least 30 yards of yarn thereon;

spring motor means mounted within said housing and operatively connected to but having a rotational axis spaced-apart from the rotational axis of said yarn supply spool for providing tension on the yarn being fed to said fabric formation machine and taking up yarn on said spool while maintaining tension on said yarn, said spring motor means being adapted to be repetitively wound tight and then partially unwound prior to being wound tight again as at least 30 yards of yarn is being continuously fed under tension by said yarn carrier apparatus to a fabric formation machine; and drive means operatively connected between said spring motor means and said yarn supply spool for transmitting biasing force from said spring motor means to said yarn supply spool, said drive means comprising a first rotational drive element operatively connected to said spring motor means, a second rotational drive element operatively connected to said yarn supply spool, and at least one rotational drive element operatively positioned between said first and second rotational drive elements so as to multiply rotational movement between said first rotational drive element and said second rotational drive element at a ration between 1:7 and 1:64 and to provide for continuous retraction of at least 25 feet of yarn under tension onto said yarn supply spool;

wherein said spring motor means comprises a ring element having a coil spring positioned therein, said coil spring defining engagement means at one end thereof for operatively engaging said first rotational drive element and being secured at the other end thereof to said ring element, said coil spring further comprises a radially movable elongate element secured proximate to the secured end of said spring and extending through an aperture in said ring so as to engage said housing, said elongate element being adapted to be withdrawn radially inwardly when said coil spring is wound tight and to thereby allow said spring motor means to rotation relative to said housing so as to partially unwind said spring, said rotating distance being determined by a plurality of spaced-apart recesses defined within said housing around the periphery of said spring motor means.

* * * * *